United States Patent [19]

Filippini et al.

[11] 4,135,661

[45] Jan. 23, 1979

[54] CONTROL DEVICE FOR A VALVE ACTUATOR

[75] Inventors: Umberto Filippini, Lastra a Signa (Florence); Pierluigi Bianchini, Florence, both of Italy

[73] Assignee: Nuovo Pignone S.p.A., Italy

[21] Appl. No.: 668,805

[22] Filed: Mar. 19, 1976

[30] Foreign Application Priority Data

Mar. 20, 1975 [IT] Italy ..... 21453 A/75

[51] Int. Cl.[2] ..... G06M 1/276

[52] U.S. Cl. ..... 235/132 R; 200/18; 200/153 L

[58] Field of Search ..... 235/132 R, 132 E; 58/125 B; 200/38 B, 38 BA, 38 C, 38 CA, 153 L, 153 LB, 153 T, 18

[56] References Cited

U.S. PATENT DOCUMENTS

| | | | |
|---|---|---|---|
| 2,581,859 | 1/1952 | Hoye | 235/132 R |
| 2,764,350 | 9/1956 | Braatz | 235/132 R |
| 3,182,908 | 5/1965 | Wahli et al. | 235/132 E |
| 3,205,651 | 9/1965 | Stiffler | 200/38 B X |
| 3,974,962 | 8/1976 | Sulzer | 235/132 R |

*Primary Examiner*—Lawrence R. Franklin
*Attorney, Agent, or Firm*—Morgan, Finnegan, Pine, Foley & Lee

[57] ABSTRACT

In a control device such as a valve actuator, the improvement comprises means for indicating the number of revolutions undergone by the valve actuator. The rotatable valve actuator drives a plurality of spaced-apart shafts which are geared to each other in suitable driving ratios with each shaft carrying an indicator to indicate the angular position of that shaft. The combination of indicators provides an indication of the number of revolutions by the valve actuator. Means can also be provided to operate one or more sets of electrical contacts when a predetermined digital indication is reached.

2 Claims, 3 Drawing Figures b
a
26
25
13
17
18
14
15
19
20
16

7
8
9
10
11
12
4
3
2
1
24
21
A
A'

7
6
5
24

CONTROL DEVICE FOR A VALVE ACTUATOR

This invention relates to a device for indicating the number of revolutions by a rotatable member, such as a valve actuator.

Specifically, the device provides a digital indication of the revolutions made by the actuator starting from a zero setting. The device also actuates one or more sets of electric contacts, each of which can be preset independently of the other ones to operate at a predetermined digital indication.

Known control devices for actuators provide a rather gross indication of the position of the valve actuator. As a matter of fact, this position is indicated either by a pointer which is rotatable about a dial or by luminous signals indicating total closure or opening of the valve actuator. In addition, in prior art systems it is not possible to preset the positions of the valve at which the energization of electric contacts is desired. In order to coordinate the positions of the valve with the operation of the electric contacts it is necessary, at the outset, to install the actuator with its contact device on the valve and then to force the valve into the positions at which the contacts are to be energized.

The device which forms the subject-matter of the present invention has for its object the provision of a new and improved control device for a valve actuator which affords the following advantages:

1. An accurate indication of the number of revolutions of the valve actuator starting from a preselected zero setting;
2. an easier calibration of the actuation of the sets of electric contacts, two of which are usually, but not necessarily, employed for indicating the two end stroke positions of a valve;
3. greater accuracy and improved repeatability of the actuation of the aforementioned contacts; and
4. the possibility of calibrating the sets of contacts separately and prior to installing the actuator on the valve, or, at any rate, on the apparatus actuated thereby.

Other objects and advantages of the present invention may be more clearly seen by reference to the accompanying drawings wherein.

Figure 2:
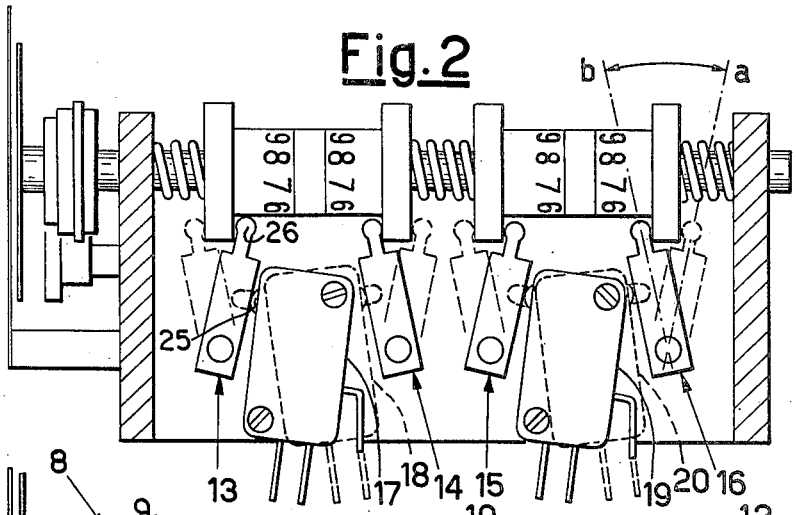
FIG. 2 is a view taken along the line A—A of FIG. 1.
Figure 1:
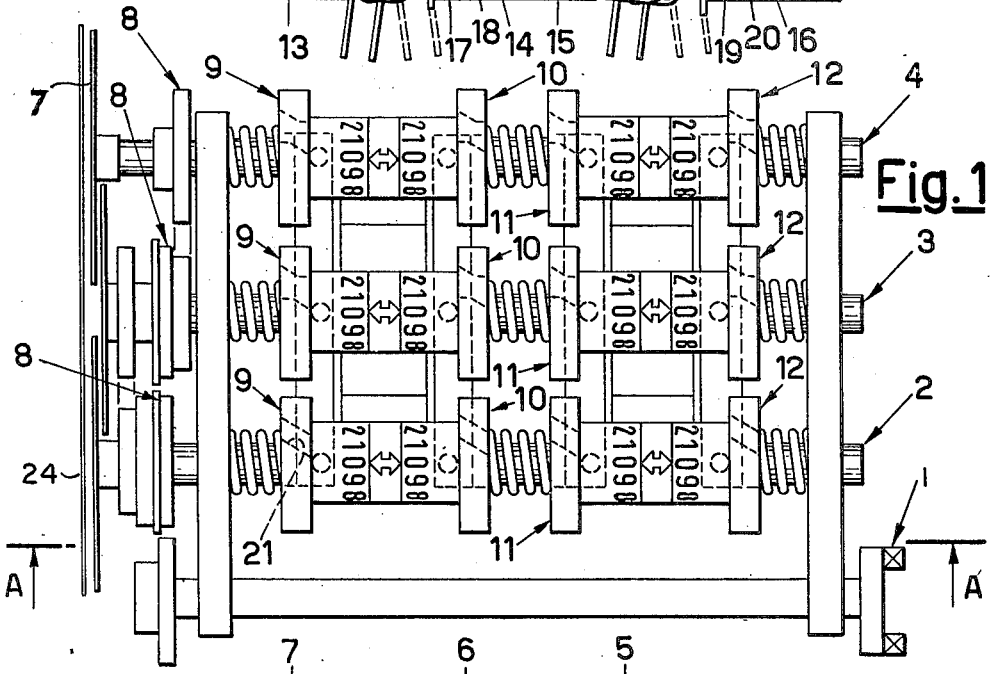
FIG. 1 is a top view of the control device comprising the present invention.
Figure 3:
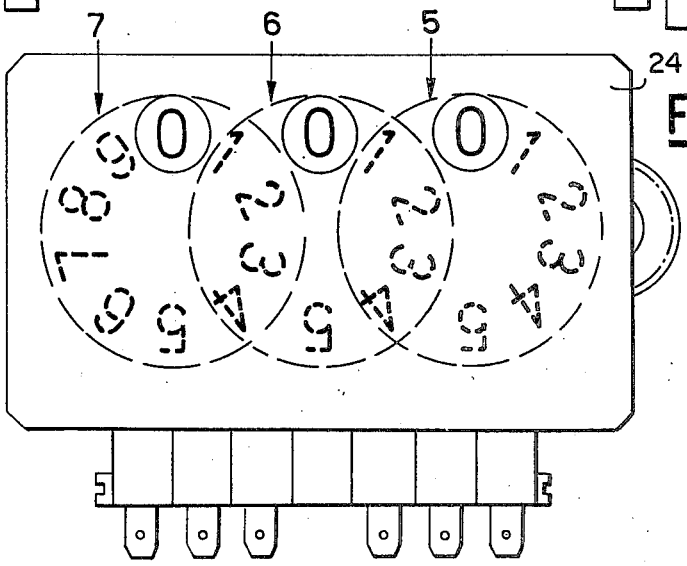
FIG. 3 is a front elevational view of the device of FIG. 1 with portions shown in phantom.

Constructional modifications of the invention which is described hereinafter in greater detail can be introduced without departing from the scope of the present invention, more particularly, the number of digits of the revolution counter and the number of the electric/contacts to be operated can be varied.

As shown in the drawings the device essentially comprises four rotary shafts: With shaft 1 receiving the drive directly from an actuator not shown, since it is connected with the rotary central group thereof, by a constant mesh gear couple. The driving ratio can be varied according to the particular application in such a way that a revolution of the actuator corresponds to one revolution, a plurality of revolutions or only a fraction of a revolution of the shaft 1.

The shaft 2 is driven in direct drive with a driving ratio of 1:1 by the shaft 1 through the gears 8. On the shaft 2 the unit disc 5 is integrally mounted.

The shaft 3 is driven by the shaft 2 through the gears 8, at a ratio of one step corresponding to one tenth of a revolution for each complete revolution of the shaft 2. On the shaft 3 there is integrally mounted the tens disc 6.

The shaft 4 is driven by the shaft 3 through the gears 8, at a ratio of one step corresponding to one tenth of a revolution for each complete revolution of the shaft 3. The hundreds disc 7 is integrally mounted on shaft 4.

From the outside of the actuator it is possible to see on each numbered disc the digit which comes into registry with an aperture in the panel 24. Thus the set of the three digits forms a number which is proportional to the number of revolutions of the shaft 1, a number which, in turn, is proportional to the number or revolutions made by the actuator starting from an initial 000 condition. Thus the read out number is also an index of the position of the apparatus not shown as actuated by the actuator.

The second function of the present invention is the actuation of the four sets of electric contacts 17, 18, 19, 20, each of them being capable of operation independently of the others, when a predetermined digital indication is reached.

The energization of the electric contacts 17–20 is in a pushbutton manner: the pushbuttons (one of which is indicated by numeral 15 in FIG. 2) of each set are, in their turn, respectively controlled by the pivotally mounted plates 13, 14, 15, 16. Each of these plates carries three fixed pins (one of which is indicated by the numeral 26 in FIG. 2), ganged in a comblike arrangement, each pin corresponding to one cam follower of the cam triplets 9, 10, 11, 12.

Each cam triplet 9–12 controls, through its associated pins, a corresponding plate 13–16 and thus a set of electric contacts.

The cams of the cam triplets operate in the following manner: Each cam comprises a disc with a sloping groove 21 engaging a pin of the swinging plate. When the three cams of a triplet are rotated and simultaneously present their respective grooves in registry with the pins of a plate, the latter is switched from the position a (shown in solid outline in FIG. 2) to the position b (shown in dotted lines in FIG. 2) and vice versa depending on the direction of rotation.

The above action is also due to the particular shape of the grooves 21 and the action of certain springs (not shown) which urge the pivotal plates into a vertical position and thus keep the plate pins urged against the cam discs, irrespective of the fact that the plates are in the a position or in the b position.

It is apparent that the cams of the cam triplet each engage in the same manner the three pins of one plate for one and only one position of the three shafts 2, 3, 4 or for one and only one digital combination.

Inasmuch as each cam can be keyed to its respective shaft by placing the groove 21 in registry with any one of the ten digits of the number disc, the result is that each swinging plate and thus each set of electric contacts can be actuated, or it can change its position, in correspondence with any value of the digital indication from 000 to 999 inclusive.

In order to facilitate the positioning of each cam on its respective shaft so as to provide the cam triplet with a desired combination, each cam is integral with a drum bearing digits from 0 to 9 so that when the device is reset (digital indication 000 on discs 5, 6 and 7) on each of the four cam triplets there is a direct reading of the combination at which the respective contact set is operated.

What we claim is:

1. A control device for indicating the number of revolutions of a rotatable member comprising:

a plurality of rotatable spaced-apart shafts, said shafts being substantially parallel to each other and in the same plane, gear means coupling each of the rotatable shafts to an adjacent shaft in a predetermined driving ratio, each of said shafts including means for indicating the angular position of the particular shaft, said indicating means comprising a disc mounted axially on the shaft with numerals arranged circumferentially thereabout such that units, tens and hundreds are depicted on respective discs to indicate the revolutions of the rotating member in accordance with said predetermined driving ratios, means coupling the rotatable member to the rotatable shafts so that said shafts are driven thereby such that the combination of means indicating the angular position of each shaft provides an indication of the number of revolutions by the rotatable member, a plurality of substantially disc-like cams mounted axially on each of the plurality of shafts, each cam having an angled groove extending from one face to the opposite face, a pivotally mounted element carrying a plurality of cam followers, the cam followers each being urged to abut a particular face of a cam until said cam followers register with the cam grooves with rotation of the shafts so that the followers pass through the grooves to the opposite face of the cam and cause movement of the element, and switch means being engaged by the element to effect an electrical contact at a predetermined time.

2. A control device for indicating the number of revolutions of a rotatable member comprising:

a plurality of rotatable spaced-apart shafts, said shafts being substantially parallel to each other and in the same plane, gear means coupling each of the rotatable shafts to an adjacent shaft in a predetermined driving ratio, each of said shafts including means for indicating the angular position of the particular shaft, said indicating means comprising a disc mounted axially on the shaft with numerals arranged circumferentially thereabout such that units, tens and hundreds are depicted on respective discs to indicate the revolutions of the rotating member in accordance with said predetermined driving ratios, means coupling the rotatable member to the rotatable shafts so that said shafts are driven thereby such that the combination of means indicating the angular position of each shaft provides an indication of the number of revolutions by the rotatable member, a plurality of substantially disc-like cams mounted rotatably on each of the plurality of shafts, each of said cams having an angled groove extending from one face to the other face which can be rotatable with respect to the indicating means carried by a particular shaft so that operation of electric contacts occurs at a preset variable number of revolutions of the rotatable member, a pivotally mounted element having cam followers mounted thereon corresponding to each cam and engaging the cam grooves at predetermined angular positions of the shaft to cause movement of the element, and switch means being engaged by the element to effect an electrical contact.

* * * * *